US007036910B2

(12) United States Patent
Ohashi et al.

(10) Patent No.: US 7,036,910 B2
(45) Date of Patent: May 2, 2006

(54) LIQUID EJECTION HEAD, RECORDING APPARATUS HAVING SAME AND MANUFACTURING METHOD THEREFOR

(75) Inventors: Tetsuya Ohashi, Matsudo (JP); Yasuo Kotaki, Yokohama (JP); Hiroaki Mihara, Machida (JP); Noriko Sato, Mitaka (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 154 days.

(21) Appl. No.: 10/670,398

(22) Filed: Sep. 26, 2003

(65) Prior Publication Data

US 2004/0174412 A1 Sep. 9, 2004

(30) Foreign Application Priority Data

Sep. 30, 2002 (JP) ..... 2002/287546
Jan. 30, 2003 (JP) ..... 2003/021889

(51) Int. Cl.
*B41J 2/14* (2006.01)

(52) U.S. Cl. ..... 347/50

(58) Field of Classification Search ..... 347/50, 347/86, 74, 49; 346/140
See application file for complete search history.

(56) References Cited

U.S. PATENT DOCUMENTS

| | | | | |
|---|---|---|---|---|
| 3,863,261 | A | 1/1975 | Klein | |
| 4,695,854 | A * | 9/1987 | Cruz-Uribe | 347/40 |
| 5,515,086 | A | 5/1996 | Kakizaki et al. | |
| 5,550,570 | A | 8/1996 | Kurata et al. | |
| 5,604,523 | A * | 2/1997 | Tsukuda et al. | 347/86 |
| 5,835,111 | A | 11/1998 | Balazer | |
| 6,151,046 | A | 11/2000 | Abe et al. | |
| 6,220,697 | B1 | 4/2001 | Yamanaka et al. | |

FOREIGN PATENT DOCUMENTS

| | | |
|---|---|---|
| JP | 5-50633 | 3/1993 |
| JP | 5-41825 | 6/1993 |
| JP | 5-229144 | 9/1993 |
| JP | 7-25112 | 1/1995 |
| JP | 9-150540 | 6/1997 |
| JP | 10-100401 | 4/1998 |
| JP | 2814330 | 8/1998 |
| JP | 2002-200742 | 7/2002 |

* cited by examiner

*Primary Examiner*—Shih-Wen Hsieh
*Assistant Examiner*—Rachel S Dicht
(74) *Attorney, Agent, or Firm*—Fitzpatrick Cella Harper & Scinto

(57) ABSTRACT

A liquid ejecting head includes a card edge contact having a plurality of electrical contacts for transmission of a driving signal; a recording element substrate having a recording element for generating energy contributable to eject liquid onto a recording material in response to the driving signal; and an electrical flexible cable for electrical connection between the card edge contact and the recording element substrate.

24 Claims, 12 Drawing Sheets

LIQUID EJECTION HEAD, RECORDING APPARATUS HAVING SAME AND MANUFACTURING METHOD THEREFOR

BACKGROUND OF THE INVENTION

Field of the Invention

The present invention relates to a liquid ejection recording head which records on recording medium such as paper and fabric by ejecting liquid thereon, a method for manufacturing the liquid ejection recording head, and a recording apparatus employing the liquid ejection recording head.

Presently, the so-called serial type recording apparatus is one of the mainstream recording apparatuses. It has a single or plurality of recording heads, and a carriage on which the recording heads are disposed. It records an image by reciprocally moving the carriage in the direction perpendicular to the direction in which recording medium is conveyed, in a manner of scanning the recording medium. This is apparently for the following reasons. That is, a serial type recording apparatus can form an image with the use of a recording head substantially smaller than a recording area, and therefore, can be easily reduced in size as well as price.

A serial type recording apparatus requires that electrical connection be maintained between the recording head on the carriage and the controlling means of the main assembly of the recording apparatus even during carrier movement. Therefore, the controlling means and the recording head are electrically connected by a flexible cable.

There are various methods for maintaining electrical connection between the recording head and the recording head main assembly. For example, there are: soldering; insertion of a card edge chip of the recording head into a cable connector of the recording apparatus main assembly; keeping a pad of the head substrate, or pad of the flexible cable, pressed on a connector pin, or rubber pad, of the main assembly; etc. A recording apparatus employing the latter method is disclosed in Japanese Patent No. 2814330, for example.

With the use of soldering, once a recording head is attached, it is impossible to remove the recording head, making it impossible for a user to replace the recording head when the user wants to use a recording head of a different type, or when the recording head has a problem.

In recent years, the number of nozzles on a recording head has been increased to improve the recording head in image quality and recording speed. This has resulted in an increase in the number of electrical contact points on the recording head side as well as the recording apparatus main assembly side. Therefore, in the case of a connecting method in which the electrical connection pad of a recording head is kept in contact with the connector pin, or rubber pad, of the recording apparatus main assembly, a substantial amount of contact pressure must be maintained between the two sides, thereby subjecting the recording head and recording apparatus main assembly to a substantial amount of reactive force. For example, according to one of the conventional structural arrangements for this connecting method, all the electrical contact points on the recording head side are placed on one surface of a recording head, and all the electrical contact points on the recording apparatus main assembly side are placed on one of the internal surfaces of the carriage in which a recording head is to be mounted. Then, the recording head is mounted in the carriage so that the electrical contact points on one surface are kept pressed on the corresponding electrical contact points on the other surface. Therefore, the amount of the pressure necessary to be maintained between the two sides is substantial. More specifically, if contact pressure per connector pin is 50 g, and the number of connector pins is 40, the surface of the recording head shell, on which the connector pins are disposed, is subjected to approximately 2 kg of force.

In this case, the surface on the recording head, which holds the electrical connection pad of the flexible cable of the recording head, or the electrical circuit chip, is required to be of high strength. Therefore, the number of locations at which the electrical connection pad can be placed is limited, thereby affording less latitude in recording apparatus design. In addition, the employment of such a measure as increasing the thickness of the structural members of a recording head or a carriage in order to improve a recording head and a carriage in rigidity, results in an increase in the size of the recording apparatus, which is a problem.

In particular, in the field of portable printers, that is, printers which can be carried with one hand, it is one of the most essential design objectives to reduce the printer in size and weight. Thus, in this field, it is desired to reduce the thickness of the structural wall of the carriage as much as possible, even by a unit of as small as 0.1 mm. On the other hand, it must be assured that the recording head and the carriage remain electrically connected. In other words, the walls of the carriage must be made as thin as possible, while assuring that the recording head remains electrically connected to the carriage.

When a recording head which employs an ink jet recording method, that is, a recording head which ejects liquid such as ink, is in operation, a substantial amount of ink sometimes adheres to the internal areas of the recording apparatus adjacent to the path of the recording head. This adhesion of ink, which is traceable to the ink mist generated as ink is ejected, and/or the head recovery operation, reduces the number of areas in which electrical contact points can be disposed; thus, latitude is reduced in the positioning of the electrical contact points. In other words, it is rather difficult to find, in an ink jet recording apparatus, an area in which ink is not likely to adhere to the electrical contact points thereof. Therefore, an ink jet recording apparatus is vulnerable to short circuiting or the like.

In comparison to the above-described connection method employing an electrical contact pad, in a connective method in which a card edge contact is inserted into a cable connector on the recording apparatus side, the reactive force between the two sets of electrical contact points is eliminated by the card edge contact and cable connector, having no direct effect on the carriage or the recording head. Therefore, it is unnecessary to provide the structural members of the carriage and the recording head with rigidity high enough for them to withstand the force generated by the contact between a conventional recording head and a conventional carriage when the two are connected to each other. In other words, this connective method is more suitable for achieving size reduction of a recording apparatus.

However, in the case of a liquid ejection recording head having a conventional card edge contact, the wiring and the contact of the recording element chip for ejecting liquid in response to the driving signals sent from the recording apparatus main assembly are electrically connected to each other, only by a patterned electrical circuit formed on a rigid substrate such as a glass-epoxy substrate or the like. In other words, the card edge pattern is on this rigid substrate. Since this substrate is not flexible, it does not afford any latitude in terms of where the electrical contact of the recording head is to be positioned, and the direction in which it is to be pointed. Thus, this connective method also is vulnerable to the problem of electrical short circuiting caused by the aforementioned ink adhesion traceable to the ink misting which occurs when ink is ejected, and the ink adhesion traceable to the recovery operation.

In other words, the positioning of the electrical contact in a conventional portable printer, which is usable not only in the upright position but also in the horizontal position, needs a great deal of improvement in terms of the mounting of the recording head into the carriage, the space required for the mounting, the ink mist adhesion to the electrical connective portion, and the secure attachment of electrical connective members to structural members.

SUMMARY OF THE INVENTION

The primary object of the present invention is to provide a liquid ejection recording head capable of improving a liquid ejection recording apparatus in terms of the reliability of electrical connection between a liquid ejection recording head cartridge and a recording apparatus, easily mountable in a recording apparatus, and reducible in size; a method for manufacturing the liquid ejection recording head; and a recording apparatus employing the liquid ejection recording head.

Another object of the present invention is to provide a liquid ejection recording head which comprises a card edge contact having a plurality of electrical contact points through which driving signals are transmitted, and a recording element chip holding recording elements for generating energy used for ejecting liquid onto a recording medium in response to the driving signals, wherein the card edge contact is electrically connected to the recording element chip by a flexible electrical cable; a method for manufacturing the liquid ejection recording head; and a recording apparatus employing the liquid ejection recording head.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

Figure 1B:
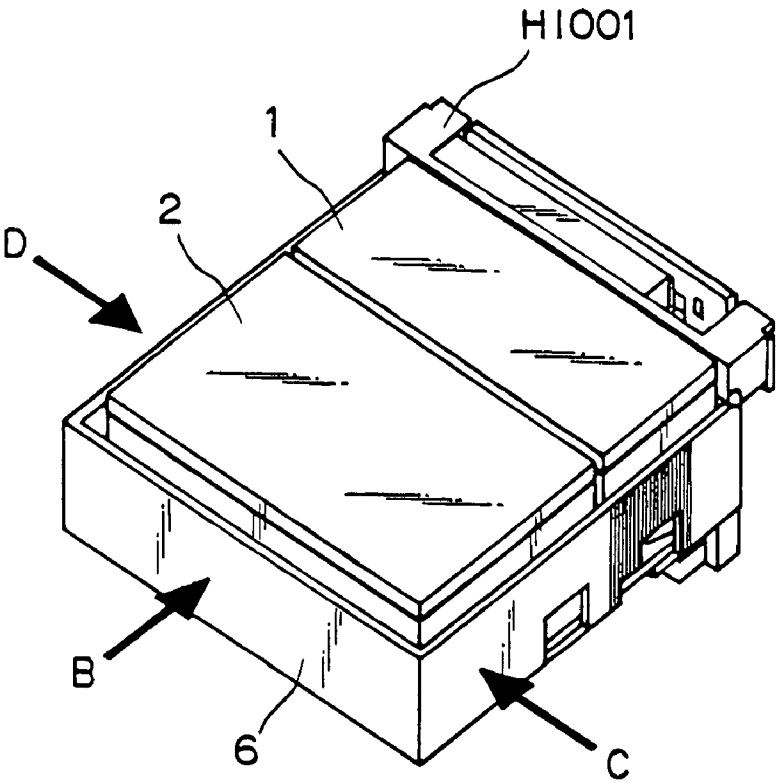
FIG. 1 (comprising FIGS. 1A and 1B, hereafter referred to as FIG. 1) is a schematic perspective view of the entirety of the recording head in the first embodiment of the present invention.
Figure 1A:
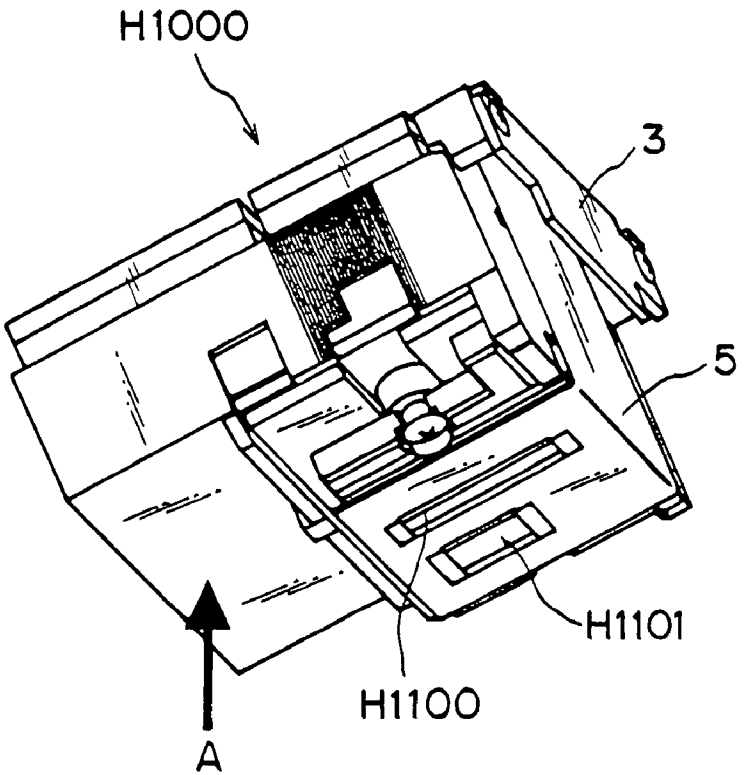
Figure 2:
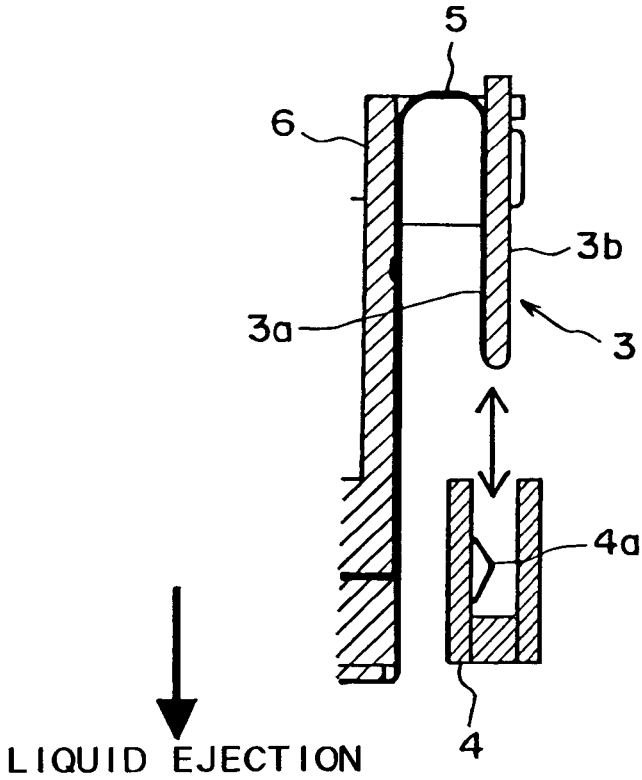
FIG. 2 is an enlarged schematic view of the card edge contact of the recording head shown in FIG. 1, and a card edge connector.
Figure 3:
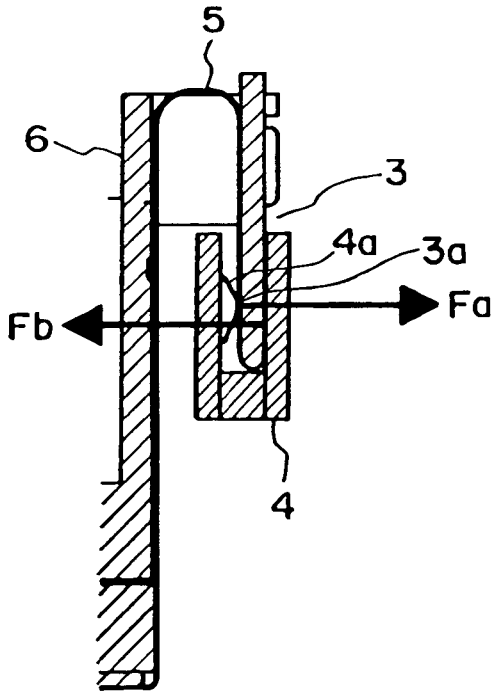
FIG. 3 is also an enlarged schematic view of the card edge contact of the recording head shown in FIG. 1, and a card edge connector.

FIG. 1 is a schematic perspective view of the entirety of the recording head in the first embodiment of the present invention, FIGS. 1A and 1B being views as seen from the recording element chip side, and ink container side, respectively. FIGS. 2 and 3 are enlarged schematic sectional views of the card edge contact of the recording head shown in FIG. 1, and a card edge connector.

A recording head H1001 has an ink container holder 6, which serves as the frame of the recording head H1001. A recording head cartridge H1000 comprises the recording head H1001, and ink containers 1 and 2 removably mountable in the ink container holder 6. The ink container 1 contains black ink, and the ink container 2 contains three color inks, that is, cyan, magenta, and yellow inks, which are separated by partitioning walls.

The recording head H1001 is removably mounted on a carriage 103 (FIG. 17) as a head supporting member of the main assembly of a recording apparatus (FIG. 17), being fixed in position relative to the carriage 103 by a positioning means. Referring to FIG. 2, when the recording head H1001 is mounted on the carriage 103, the card edge contact 3 of the recording head H1001 is inserted into the hole of the card edge connector 4 on the recording apparatus side. The insertion makes the electrical contact points 3*a* on the card edge contact side come into contact with the electrical contact points 4*a* on the card edge connector side (see FIGS.

2 and 3), establishing electrical connection between the card edge contact 3 and card edge connector 4.

Thus, while the card edge contact 3 is electrically in contact with the card edge connector 4, the card edge contact 3 remains under the contact pressure Fa from the electrical contact points 4*a* of the card edge connector 4 as shown in FIG. 3, and the card edge contact 3 is kept pressed against one of the internal surfaces of the card edge connector 4, that is, the surface opposite to the surface having the electrical contact points 4*a*, being therefore supported by the surface opposite to the surface having the electrical contact points 4*a*. The reactive force Fb which the card edge contact 3 receives from the card edge contact supporting surface of the card edge connector 4 is equal to the contact pressure Fa. Further, the reactive force Fb acts in the direction opposite to the direction in which the contact pressure Fa does. Thus, the contact pressure Fa and the force Fb reactive thereto cancel each other out. Therefore, the stress caused by the physical contact made to establish electrical connection between the card edge contact 3 and card edge connector 4 does not affect anything but the card edge contact 3 and card edge connector 4, eliminating the need for providing the recording head H1001, in particular, the structural members (structural members to which the card edge contact is attached) of the recording head H1001 in the adjacencies of the card edge contact 3, with an additional structure for increasing the rigidity of the structural members to enable the structural members to withstand the stress which is generated when the card edge contact 3 is connected to the card edge connector 4. Therefore, it is possible to reduce the size of the recording head H1001.

Referring to FIG. 1(*a*), the recording head H1001 is provided with recording element chips H1100 and H1101 for ejecting ink onto a recording medium by causing ink to boil in the so-called film boiling fashion, in response to driving signals from the recording apparatus, with the use of electro-thermal transducer elements. The first recording element chip H1100 is for black ink, and is structured so that it ejects the black ink supplied to the first recording element chip H1100 from the ink container 1 in which the black ink is stored. The second recording element chip H1101 is for color inks, and is structured so that it ejects three inks different in color supplied to the second recording element chip 1101 from the ink container 2 in which the three color inks are stored. Next, referring to FIGS. 4 and 5, the two recording element chips H1100 and H1101 will be described in detail.

Figure 4:
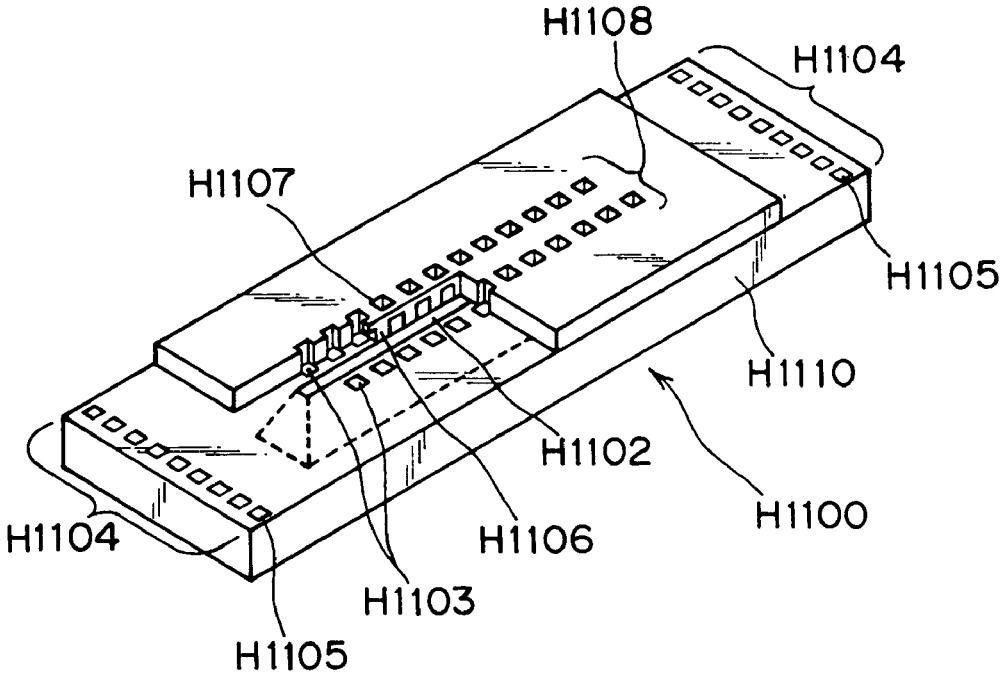
FIG. 4 is a schematic perspective view of the first recording element chip shown in FIG. 1.

FIG. 4 is a schematic perspective view of the first recording element chip shown in FIG. 1, a part of which has been removed to describe the structure of the chip.

The first recording element chip H1100 comprises a substrate H1110 formed of, for example, silicon, with a thickness of 0.5 mm–1.0 mm, which has an ink supply hole H1102, as an ink passage, that is, a through hole resembling a long groove. The first recording element chip H1100 also has a plurality of electro-thermal transducer elements H1103, which are disposed in two straight lines, one on each side of the ink supply hole H1102. The first recording element chip H1100 is also provided with unshown electrical wiring for supplying the electrothermal transducer elements H1103 with electrical power. The electrical wiring is formed of aluminum or the like. These electro-thermal transducer elements H1103 and electrical wiring are formed using film forming technologies. The electro-thermal transducer elements H1103 are arranged so that a line alternately connecting the elements in one line and those in the other line is zigzag. Corresponding to this arrangement of the electro-thermal transducer elements H1103, ejection holes H1107, which will be described later, in one line are slightly offset, in terms of the direction of their alignment, from the adjacent ejection holes H1107 in the other line so that the line connecting a given ejection hole H1107 in one line to the closest ejection hole H1107 in the other line is not perpendicular to the direction of the two lines.

Further, the first recording element chip H1100 is provided with a plurality of electrical contact points H1104 for supplying the electrical wiring with electrical power. The electrical contact points 1104 are arranged along the opposing two edges of the first recording element chip H1100, which are perpendicular to the two lines of the electro-thermal transducer elements H1103. Each electrical contact point is in the form of a bump H1105, and is formed of gold or the like. The surface of the silicon substrate H1110, which has the above-described elements, is covered with a top plate having a plurality of ink passages and a plurality of ejection holes H1107. Each of the ink passages is surrounded by ink passage walls H1106, and corresponds in position to a given electro-thermal transducer element H1103. The top plate is formed of a resin, with the use of photolithographic technologies. The ejection holes H1107 are disposed in a manner to oppose the electro-thermal transducer elements H1103, one for one, forming an ejection hole group H1108.

As black ink is supplied from the ink container 1 to the ink supply hole H1102 of the first recording element chip H1100 structured as described above, the black ink is ejected by the pressures from the bubbles generated by the heat generated by the specific electro-thermal transducer elements H1103, from the ejection holes 1107 corresponding to the specific electro-thermal transducer elements H1103, one for one.

Figure 5:
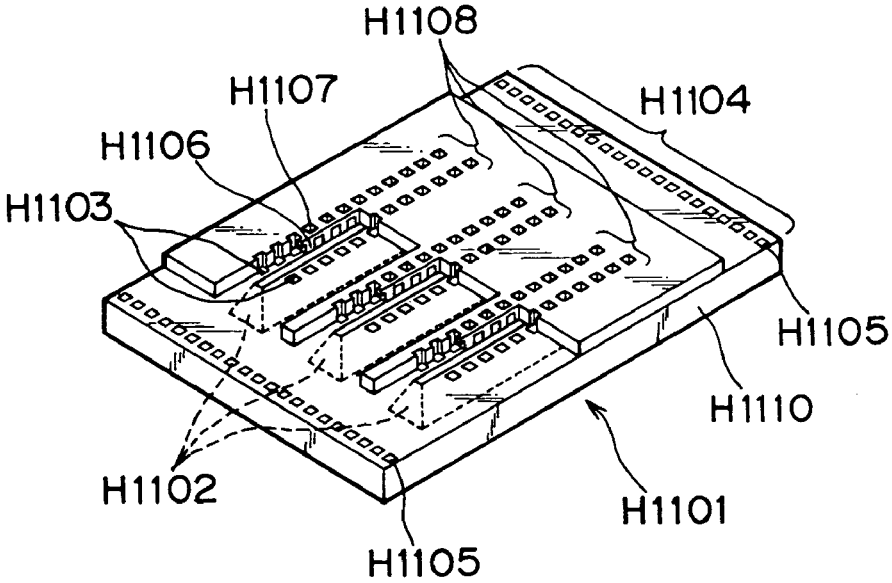
FIG. 5 is a schematic perspective view of the second recording element chip shown in FIG. 1.

FIG. 5 is a schematic perspective view of the second recording element chip shown in FIG. 1, a part of which has been removed to describe the structure thereof.

The second recording element chip H1101 is for ejecting three color inks, that is, cyan, magenta, and yellow inks. It has three ink supply holes H1102, as ink passages, which are through holes, each resembling a long groove. The three ink supply holes H1102 are disposed in parallel. Each ink supply hole H1102 is flanked by two lines of electro-thermal transducer elements H1103, one on each side, and two lines of ink ejection holes H1107, one on each side. The electro-thermal transducer elements H1103 are arranged so that a line connecting alternately the electro-thermal transducer elements H1103 in one line with those in the other line is zigzag, and the ink ejection holes H1107 are arranged in the same fashion. The silicon substrate H110 of the second recording element chip H1101 is provided with electrical wiring, electrical contact points H1104, etc., as is the silicon substrate H110 of the first recording element chip H1100. It is covered with a top plate having a plurality of ink passages and the plurality of ink ejection holes H1107. Each of the ink passages is surrounded by ink passage walls H1106. The top plate is formed of a resin, with the use of photolithographic technologies. Further, the second recording element chip H1101 is provided with a plurality of electrical contact points H1104 for supplying the electrical wiring with electrical power. Each electrical contact point is in the form of a bump H1105, and is formed of gold or the like.

As color inks are supplied from the ink container 2 to the corresponding ink supply holes H1102 of the second recording element chip H1101 structured as described above, the color inks are ejected by the pressures generated from the bubbles created by the heat generated by the specific electrothermal transducer elements H1103, from the ejection holes H1107 corresponding to the specific electro-thermal transducer elements H1103, one for one.

Referring again to FIG. 1, the recording element chips H1100 and H1101 are electrically connected to the card edge contact 3 by a flexible electrical cable 5. Referring to FIG. 2, the recording head H1001 is structured so that the direction in which the card edge contact 3 is inserted into the card edge connector 4 is virtually parallel to the direction in which liquid is ejected from the recording head H1001.

Figure 6:
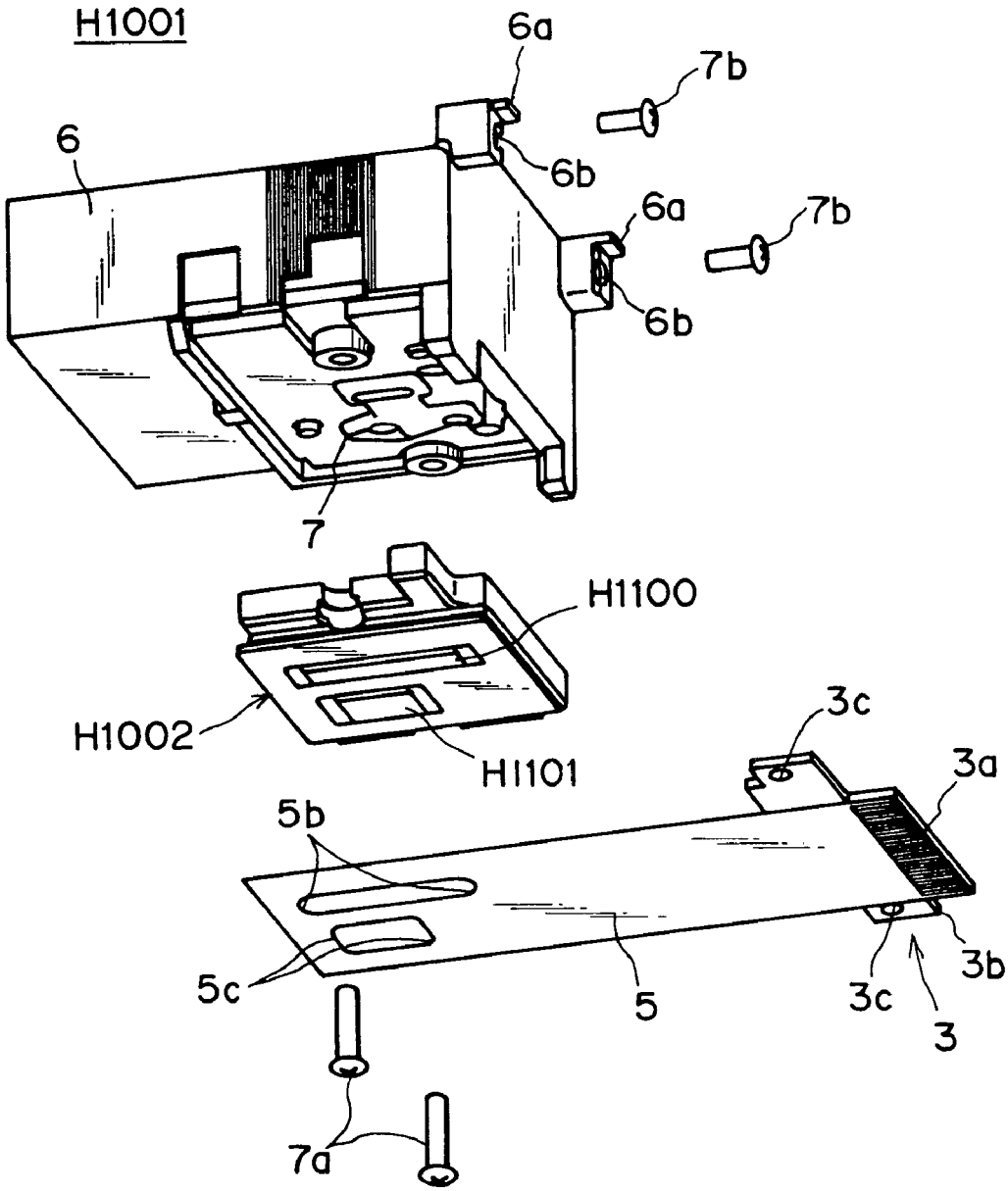
FIG. 6 is an exploded perspective view of the recording head shown in FIG. 1, for showing the structure of the recording head.

FIG. 6 is an exploded perspective view of the recording head shown in FIG. 1, for showing the structure thereof.

The flexible electrical cable 5 provides passages through which electrical driving signals for ink ejection are applied to the first and second recording element chips H1100 and H1101. It comprises a TAB substrate or a FPC substrate, and wiring printed thereon. It has two holes which correspond in position to the first and second recording element chips H1100 and H1101. It has electrode terminals 5*b* and 5*c*, which are to be connected to the electrical contact portions H1104 of the recording element chips H1100 and H1101, respectively, and which are disposed along the edges of the two holes. The flexible electrical cable 5 is solidly attached to a recording element unit H1002 with the use of glue, and these electrode terminals 5*b* and 5*c* are connected to each of the electrical contact portions H1104 of the recording element chips H1100 and H1101, respectively, with the use of ultrasonic crimping, establishing electrical connection between the flexible electrical cable 5 and recording element chips H1100 and H1101.

The recording element unit H1002 having the flexible electrical cable 5 solidly attached thereto with glue is solidly fixed to the bottom surface of the ink container holder 6 with the use of small screws 7*a*. The bottom surface of the ink container holder 6 is provided with a joint sealing member 7, which is formed of an elastic material such as silicone rubber. The joint sealing member 7 provides a seal between the ink container holder 6 and the recording element unit H1002, and is provided with through holes through which ink supply holes of the ink container holder 6 are connected with the ink supply holes of the recording element unit H1002.

The end of the flexible electrical cable 5 in this embodiment is provided with the electrical contact points 3*a*, which are formed of copper foil and are to be connected to the card edge connector 4 (see FIGS. 2 and 3) of the recording apparatus. The portion of the flexible electrical cable 5 having the electrical contact points 3*a* is supported by a reinforcement plate 3*b* glued thereto. In other words, the card edge contact 3 comprises the electrical contact points 3*a* and the reinforcement plate 3*b*.

The reinforcement plate 3*b* is provided with a couple of screw holes 3*c* through which a couple of small screws 7*b* fit as means for solidly fixing the card edge contact 3 to the ink container holder 6. The reinforcement plate 3*b* in this embodiment is made of a glass epoxy plate with a thickness in the range of 0.3 mm–1.0 mm. However, this does not mean that the material for the reinforcement plate 3*b* should be limited to a glass epoxy plate. For example, a metallic plate such as a stainless steel plate or the like may be used. The method for attaching the reinforcement plate 3*b* to the flexible electrical cable 5 may be such that the reinforcement plate 3*b* shaped in a specific pattern is pasted to the cable 5 after being aligned with the patterned electrical contact points 3*a*.

If it is necessary to produce a card edge contact 3 with higher dimensional accuracy, the following manufacturing method can be used. That is, first, the reinforcement plate 3*b* and flexible electrical cable 5 are made to be larger than the required size, and are glued to each other. Then, a card edge contact 3 is punched out of the glued combination of the reinforcement plate 3*b* and flexible electrical cable 5 with the larger size.

Figure 7:
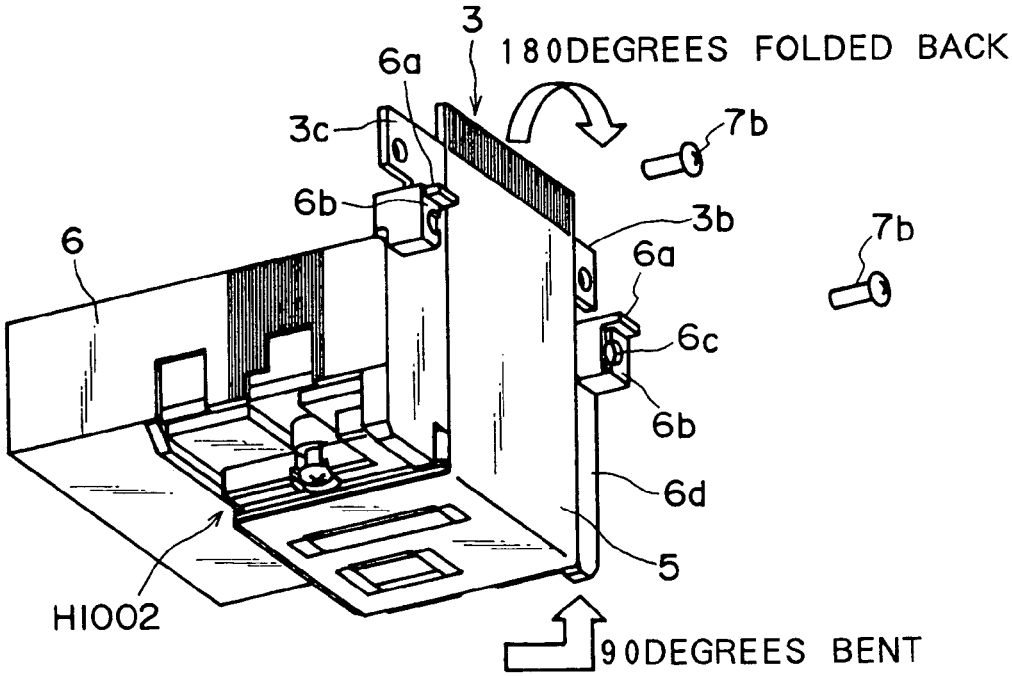
FIG. 7 is a perspective drawing of the recording head shown in FIG. 1, for showing one of the manufacturing methods for the recording head.

Next, referring to FIGS. 6 through 9, a method for manufacturing the above-described recording head will be described. FIG. 7 is a perspective view of the recording head shown in FIG. 1 and other drawings, for showing the method for manufacturing the recording head.

First, referring to FIG. 6 the flexible electrical cable 5 is solidly bonded to the recording element unit H1002 with an adhesive, and the electrode terminals 5*b* and 5*c* of the flexible electrical cable 5 are connected to the electrical contact portions H1104 of the recording element chips H1100 and H1101, respectively, by an ultrasonic crimping method, establishing an electrical connection between the flexible electrical cable 5 and recording element chips H1100 and H1101. Next, the reinforcement plate 3*b* is bonded to the end portion of the flexible electrical cable 5 opposite the other end portion by which the flexible electrical cable 5 is in connection with the recording element chips H1100 and H1101. In other words, the flexible electrical cable 5 is provided with the card edge contact 3. Then, the recording element unit H1002 having the flexible electrical cable 5 is solidly fixed to the bottom surface of the ink container holder 6, with the pair of small screws 7*a*, while being accurately positioned relative to the ink container holder 6.

Next, referring to FIG. 7, the flexible electrical cable 5 is sharply bent roughly 90° so that the flexible electrical cable 5 follows the end surface of the recording element unit H1002, and the flexible electrical cable 5 is solidly bonded, with glue, to the end surface of the recording element unit H1002 and a part of the surface 6*d* of the ink container holder 6. The part of the surface 6*d* of the ink container holder 6, to which the flexible electrical cable 5 is to be glued, is desired to extend from the end surface of the recording element unit H1002 to the approximate center of the surface 6*d*. As for the glue to be used for bonding the flexible electrical cable 5 to the ink container holder 6, thermosetting glue, for example, can be used.

Figure 8:
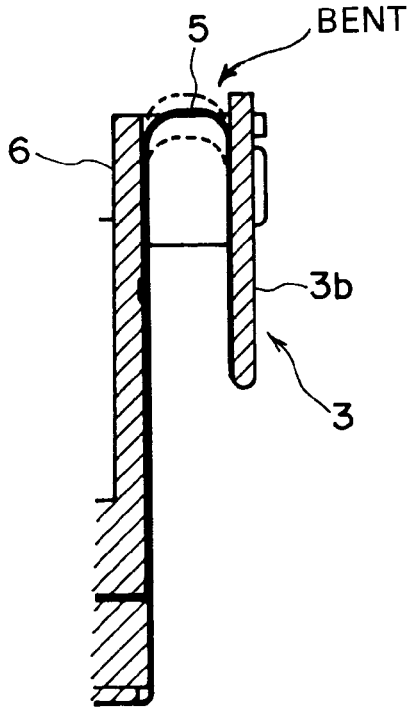
FIG. 8 is an enlarged perspective view of the card edge contact of the recording head, and its adjacencies.

Next, referring to FIG. 8 the portion of the flexible electrical cable 5 to which the card edge contact 3 has been attached, is folded back by approximately 180° so that the screw holes 3*c* of the card edge contact 3 align with the card edge contact backing portions 6*a* and 6*b* of the ink container holder 6. Then, the card edge contact 3 is solidly fixed to the ink container holder 6 (card edge contact backing portions 6*a* and 6*b*) by screwing the small screws 7*b* into the screw holes 6*c* of the card edge contact backing portions 6*a* and 6*b* after putting the screws 7*b* through the screw holes 3*c* of the card edge contact 3.

The tolerance in the measurements of the flexible electrical cable 5 itself, positioning errors which occur when bonding the reinforcement plate 3*b* to the flexible electrical cable 5, and the like errors, affect the length of the portion of the flexible electrical cable 5 from the recording element unit H1002 to the card edge contact 3. However, the variation in the length of this portion of the flexible electrical cable 5 is absorbed (compensated for), because the position of the line, at which the flexible electrical cable 5 is folded back by 180°, shifts to accommodate the variation. Therefore, the error in the length of this portion of the flexible electrical cable 5 does not affect at all the aligning of the screw holes 3*c* of the card edge contact 3 with the screw holes 6*c* of the card end contact backing portions 6*a* and 6*b* of the ink container holder 6; it does not affect the accuracy with which the card end contact 3 is positioned relative to the ink container holder 6.

As described above, according to the recording head manufacturing method in this embodiment, first, at least a part of the flexible electrical cable is bonded to a surface of the main assembly of the recording head, and then, the card edge contact is attached to the main assembly, with the flexible electrical cable bent backward by a predetermined angle over the surface to which the flexible electrical cable is bonded. Therefore, the flexible electrical cable is securely bonded to the main assembly; the flexible electrical cable is prevented from "floating".

Further, even if there is a certain amount of error in the length of the flexible electrical cable, the error is absorbed, because the location of the line, at which the portion of the flexible electrical cable which has not been bonded to the main assembly is folded back by a predetermined angle, shifts in accordance with the amount of error. Therefore, even if there is a certain amount of error in the length of the flexible electrical cable, the error has no effect at all on the attachment of the card edge contact to the main assembly.

Figure 9:
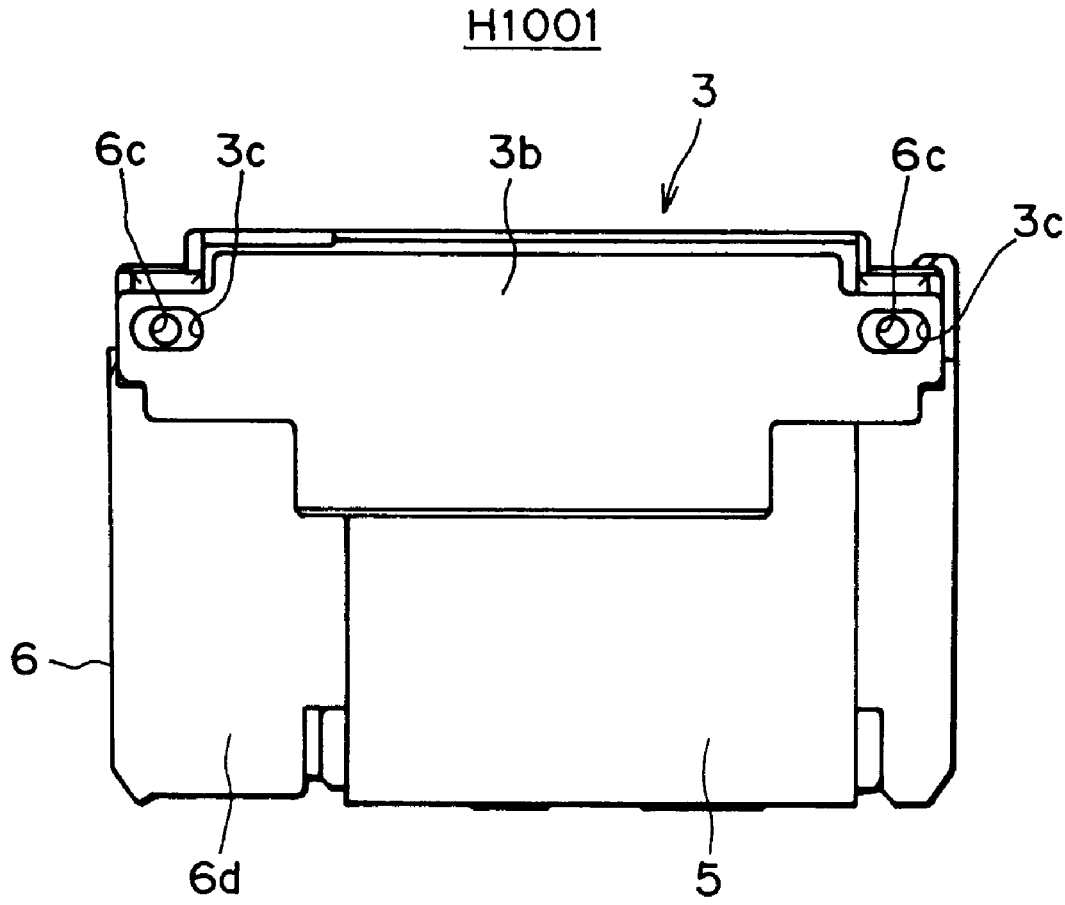
FIG. 9 is a front view of the ink container holder of the recording head shown in FIG. 1 and other drawings, and the card edge contact aligned therewith.

Moreover, referring to FIG. 9, the screw holes 3*c* of the reinforcement plate 3*b* in this embodiment are elongated in the direction (widthwise direction) perpendicular to the lengthwise direction of the flexible electrical cable 5. Therefore, even if a small amount of error occurs in the position of the reinforcement plate 3*b* relative to the ink container holder 6 in terms of the aforementioned widthwise direction due to the error which occurs when the reinforcement plate 3*b* is bonded to the cable 5, the error does not interfere with the procedure of putting the small screws 7*b*, as fixing means (FIG. 7), through the screw holes 3*c*, and screwing the small screws 7*b* into the screw holes 6*c*. In other words, the error in the positioning of the ink container holder 6 and card edge connector 3 relative to each other in terms of the above-described widthwise direction is absorbed by the elongated screw holes 3*c*. Therefore, the card edge contact 3 and the cable 5 to which the card edge contact 3 has been bonded are not subjected to stress when the card edge contact 3 is solidly fixed to the ink container 6.

Through the above-described steps, the recording head H1001 shown in FIG. 1 is assembled.

Incidentally, the means for solidly fixing the card edge contact 3 to the ink container holder 6 does not need to be limited to the pair of small screws 7*b*. For example, the following means may be employed to solidly fix the card edge contact 3 to the ink container holder 6. That is, a pair of fixation pins are employed in place of the pair of small screws 7*b*, and the card end contact backing portions are provided with a pair of through holes, through which the fixation pins are put one for one, instead of the pair of screw holes 6*c*. Then, the fixation pins are put through the holes 3*c* of the card edge contact 3, and the through holes of the ink container holder 6, and the fixation pins are crushed flat at both ends.

Further, the card edge contact 3 may be formed as a card edge chip comprising a rigid substrate and a wiring circuit formed on the rigid substrate to connect the lead wires of the flexible electrical cable 5 with the electrical contact points 3*a*. With this structural arrangement, the circuitry on the card edge chip can be rewired or integrated, making it possible to simplify the card edge contact 3 in the portion of the wiring by which it is connected to the card edge connector 4. Further, with the card edge chip being highly rigid, there is no need for the above described reinforcement plate 3*b*. In other words, the employment of the rigid card edge chip reduces the component count related to the card edge contact 3, and the number of assembly steps related to the card edge contact 3, reducing thereby the cost of the recording head cartridge. When the card edge contact is formed as a rigid card edge chip, the electrical connection between the card edge chip and flexible electrical cable 5 is established by attaching the card edge chip to the flexible electrical cable 5, with the use of an anisotropic film and the application of heat and pressure.

The positional relationship between the card edge contact 3 relative to the ink container holder 6 does not need to be limited to the one shown in FIG. 1 and other drawings. In other words, the card edge contact 3 may be placed over any of the A to D surfaces of the ink container holder 6, shown in FIG. 1, and what is necessary to do so is to change, as necessary, the flexible electrical cable 5 to be attached to the recording element unit H1002, in the direction in which the flexible electrical cable 5 is to be extended, the length of the flexible electrical cable 5, the shape of the flexible electrical cable 5, etc.

As described above, the recording head H1001 in this embodiment is scarcely subjected to the reactive force from the contact pressure Fa generated between the set of electrical contact points of the card edge contact 3 and the set of electrical contact points of the card edge connector 4, when the card edge contact 3 is connected to the card edge connector 4. Therefore, it is unnecessary for the various portions of the recording head H1001 to be increased in thickness, or provided with ribs, in order to increase the rigidity of the recording head H1001, making it possible to reduce the recording head H1001 in size.

The connection of the recording element unit H1002 to the card edge contact 3 with the use of the flexible electrical cable 5 makes it possible to optimally position the card edge contact 3 relative to the recording head H1001. Therefore, it is possible to place the card edge contact 3 in an area in which mist generated when the liquid is ejected, liquid splashed during a recovery operation, and the like stray liquid, are not likely to adhere to the flexible electrical cable 5. Therefore, it is possible to prevent the recording head H1001 from suffering from the problems caused by the adhesion of the above-described stray liquid. Moreover, as long as the error in the positioning of the card edge contact 3 relative to the flexible electrical cable 5, which occurs when the card edge contact 3 is attached to the flexible electrical cable 5, is relatively small, it is possible to absorb the error, while preventing the recording head H1001 from "floating" from the main section of the ink container holder, when the flexible electrical cable 5 is attached to the recording head H1001.

Further, as is evident from FIGS. 1 and 2, in this embodiment, the flexible electrical cable 5 is attached to the recording head H1001 in a manner to be doubled back in the space between the ink container holder 6 and reinforcement plate 3*b*, being bent roughly in the shape of the letter U, the opening of which is in the liquid ejection direction (virtually parallel to the direction in which the recording head cartridge is mounted into the carriage). Therefore, the mounting of the recording head cartridge into the carriage can be completed simply by inserting the recording head cartridge straight downward into the carriage from directly above, provided that the card edge connector on the carriage side is open straight upward. Therefore, the space otherwise necessary to rotate the recording head cartridge, or to change the direction in which the recording head cartridge is oriented, while mounting the recording head cartridge, can be eliminated, so as to make the recording apparatus smaller. In particular, in this embodiment, the direction in which the recording head cartridge is mounted into the carriage is roughly parallel to the direction in which liquid (ink) is ejected. Therefore, the space necessary to accurately position the recording head cartridge relative to the carriage while establishing electrical connection between the two is reduced.

Embodiment 2

Next, referring to FIGS. 10 and 11, the second embodiment of the present invention will be described. This embodiment is such a modification of the first embodiment that the card edge contact 3 of the recording head H1001 is changed in structure. Thus, the portions of this embodiment similar to those in the first embodiment are the same in effect as those in the first embodiment.

Figure 10B:
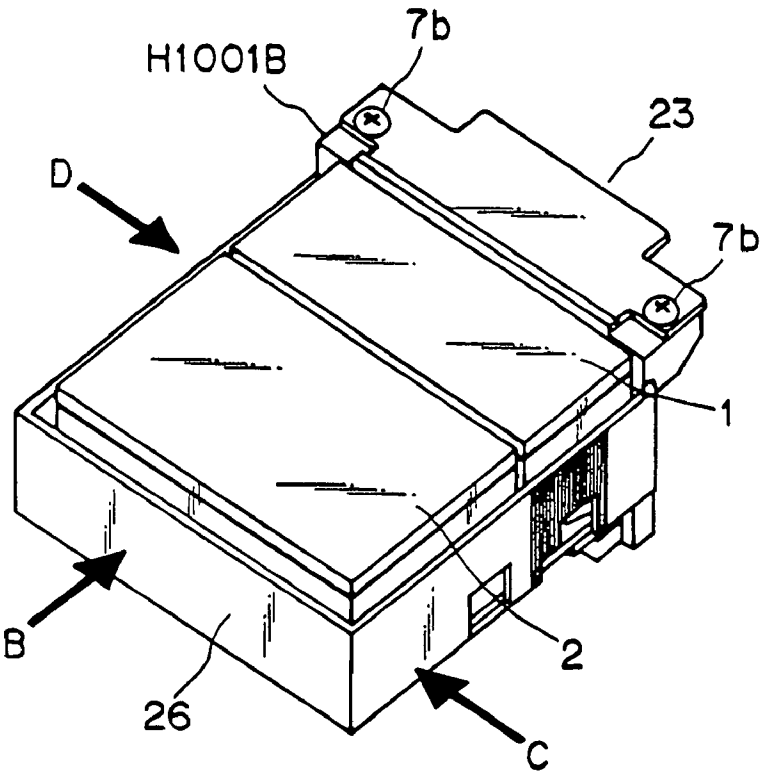
FIG. 10 (comprising FIGS. 10A and 10B, hereafter referred to as FIG. 10) is a schematic perspective view of the entirety of the recording head in the second embodiment of the present invention.
Figure 10A:
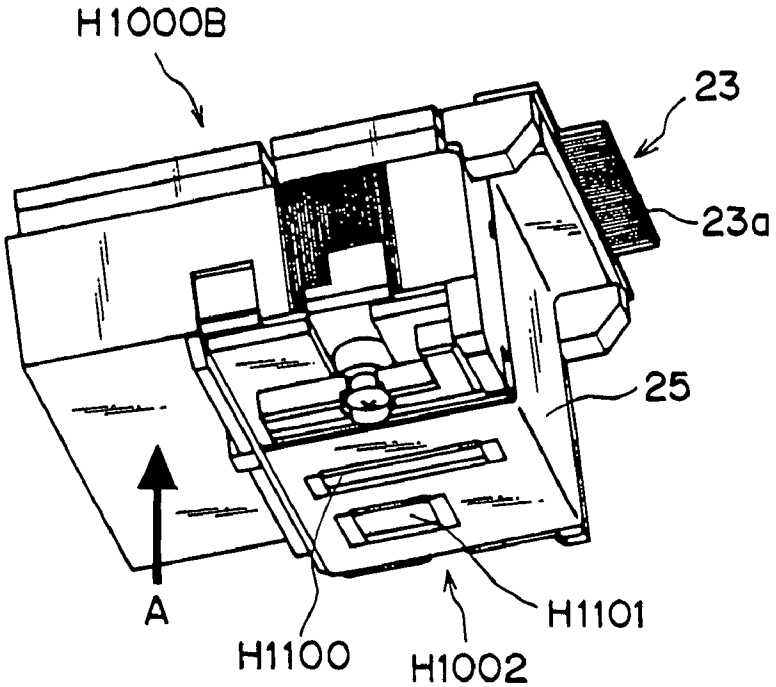
Figure 11:
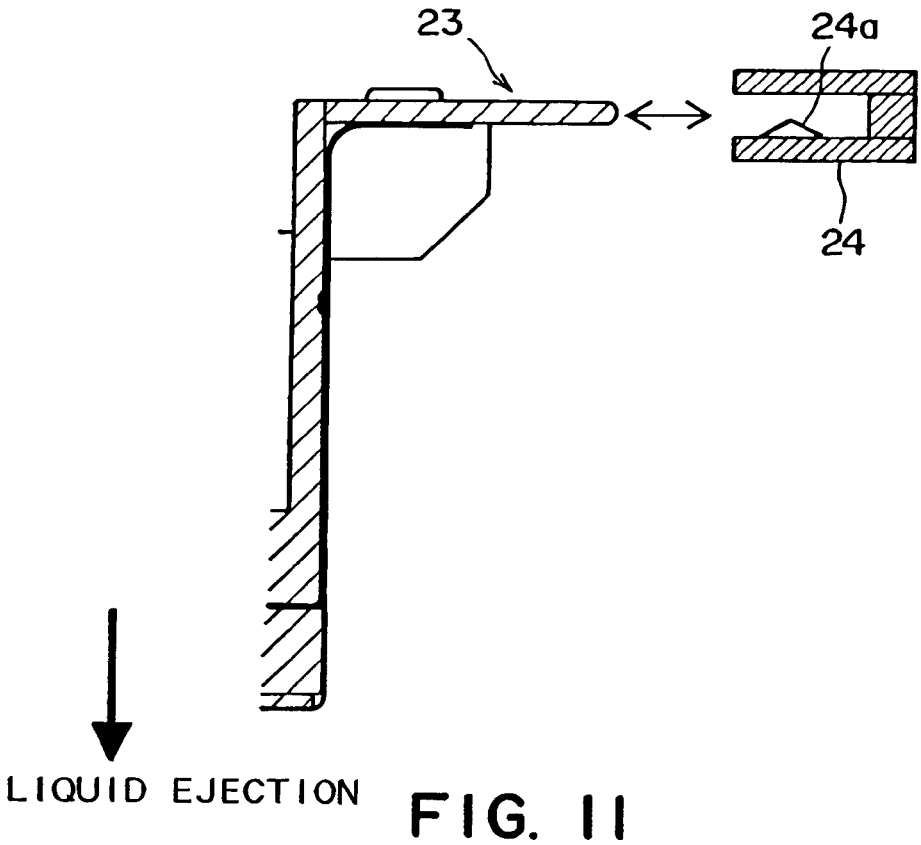
FIG. 11 is an enlarged sectional view of the card edge contact of the recording head shown in FIG. 10.

FIG. 10 is a schematic perspective view of the entirety of the recording head in the second embodiment of the present invention, and FIG. 11 is an enlarged schematic sectional view of the card edge contact of the recording head shown in FIG. 10, and its adjacencies. The components, members, portions, etc., in FIGS. 10 and 11, which are the same as those in the first embodiment, are given the same referential symbols as those given in the first embodiment, and will not be described.

Referring to FIGS. 10 and 11, in this embodiment, a recording head H1001B is structured so that the direction in which the card edge contact 23 is inserted into the card edge connector 24 on the recording apparatus (unshown) side, is virtually perpendicular to the direction in which liquid is ejected from the recording head H1001B. In other words, this embodiment is different from the first embodiment in that the direction in which the card edge contact 23 is inserted into the card edge connector 24 is different from that in the first embodiment, and therefore, the direction in which the recording head H1001B is mounted into, or removed from, the recording apparatus is different from that in the first embodiment.

In other words, the area of the recording head H1001B to which the card edge contact 23 is attached, and the orientation in which the card edge contact 23 is attached to the recording head H1001B, can be optimally set according to the structure of the recording apparatus in which the recording head H1001B is mounted. Thus, structuring the recording head H1001B so that the direction in which the recording head H1001B is inserted into a recording apparatus coincides with the direction in which the card edge contact 23 is inserted into the card edge connector 24 of the recording apparatus can make it easier to mount the recording head H1001B into the recording apparatus. It also can reduce the space necessary in the recording apparatus to manipulate the recording head H1001B, making it possible to reduce recording apparatus size.

The card edge contact 23 may be formed as a rigid card edge chip comprising a rigid substrate and a wiring circuit formed on the rigid substrate to connect the lead wires of the flexible electrical cable 25 with the electrical contact points 23*a*. With this structural arrangement, the circuitry on the card edge chip (23) can be rewired or integrated, making it possible to simplify the card edge contact 23, in the portion of the wiring by which it is connected to the card edge connector 4. Further, with the card edge chip being highly rigid, there is no need for the above-described reinforcement plate. In other words, the employment of the rigid card edge chip makes it possible to reduce the component count related to the card edge contact, and the number of assembly steps related to the card edge contact, reducing thereby the cost of the recording head cartridge. When the card edge contact 23 is formed as a rigid card edge chip (23), the electrical connection between the card edge chip (23) and flexible electrical cable 25 is established by attaching the card edge chip (23) to the flexible electrical cable 25, with the use of an anisotropic film and the application of heat and pressure.

The positional relationship between the card edge contact 23 relative to the ink container holder 26 does not need to be limited to the one shown in FIG. 10. In other words, the card edge contact 23 may be placed over any of the A to D surfaces of the ink container holder 26, shown in FIG. 10, and what is necessary to do so is to change, as necessary, the flexible electrical cable 25 to be attached to the recording element unit H1002, in the direction in which the flexible electrical cable 25 is extended, the length of the flexible electrical cable 25, the shape of the flexible electrical cable 25, etc. The portions of the recording head H1001B in this embodiment other than the above-described portions are the same in effect as those in the first embodiment.

Embodiment 3

Next, referring to FIGS. 12 and 13, the third embodiment of the present invention will be described. The portions of this embodiment similar to those in the first and second embodiments are the same in effect as those in the first and second embodiments.

Figure 12:
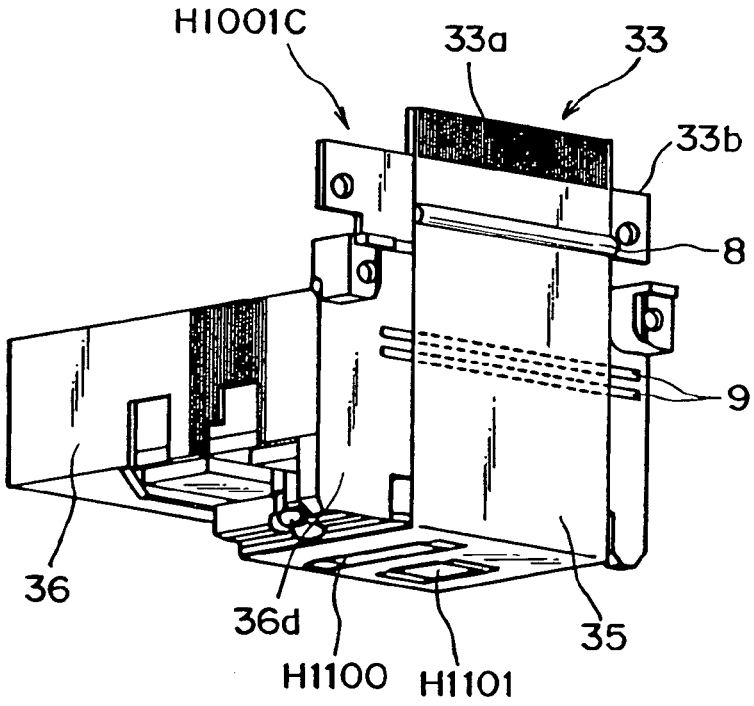
FIG. 12 is a schematic perspective view of the partially disassembled recording head in the third embodiment of the present invention.

FIG. 12 is a schematic perspective view of the entirety of the partially disassembled recording head in the third embodiment of the present invention, and shows the state of the recording head prior to the solid fixation of the card edge contact 33 to the ink container holder 36. FIG. 13 is an enlarged schematic sectional view of the card edge contact of the recording head, and its adjacencies, shown in FIG. 12.

The surface 36*d* of the recording head H1001C, to which an ink container holder 36 as the main portion of the recording head H1001C, to which the flexible electrical cable 35 is bonded, is provided with a pair of grooves 9 for capturing the liquid flow toward the card edge contact 33 which occurs as the liquid adheres to the surface of the recording head H1001C. The recording head H1001C is also provided with a ridge 8 for preventing the liquid flow toward the card edge contact 33 which occurs as liquid adheres to the surface of the recording head H1001C.

Thus, the manufacturing method for the recording head H1001C in this embodiment comprises: a process for providing the ridge 8 for blocking the liquid flow toward the card edge contact 33 which occurs as liquid adheres to the surface of the recording head H1001C; and a process for providing the surface 36*d* of the ink container holder 36, as one of the surfaces of the main assembly of the recording head H1001C, to which at least a part of the flexible electrical cable 35 is bonded, with the pair of grooves 9 for capturing the liquid flow toward the card edge contact 33 which occurs as liquid adheres to the surface of the recording head H1001C.

After adhering to the surface of the recording head H1001C, most of the liquid flows in the direction parallel to the lengthwise direction of the flexible electrical cable 35 toward the card edge contact 33. Thus, the grooves 9 and ridge 8 are extended in the direction perpendicular to the direction of the liquid flow, in other words, in the widthwise direction of the card edge contact 33. To describe this in another manner, the grooves 9 and ridge 8 are extended in the direction perpendicular to the direction in which liquid is capable of flowing from the recording element chip toward the card edge contact 33.

The ridge 8 is on the flexible electrical cable 35, near the card edge contact 33. Its height is in the range of 0.5 mm–2.0 mm, and its length is greater than the width of the electrical contact portion 33*a* of the card edge contact 33. It is positioned so that after the solid attachment of the card edge contact 33 to the ink container holder 36, the ridge 8 faces the ink container holder 36 as shown in FIG. 13.

In this embodiment, the ridge 8 is formed by coating a high viscosity sealant. As the high viscosity sealant, silicone rubber, for example, can be used. As long as the ridge 8 can be formed in a predetermined shape, the method for forming the ridge 8 does not need to be limited to the above-described one.

Figure 13:
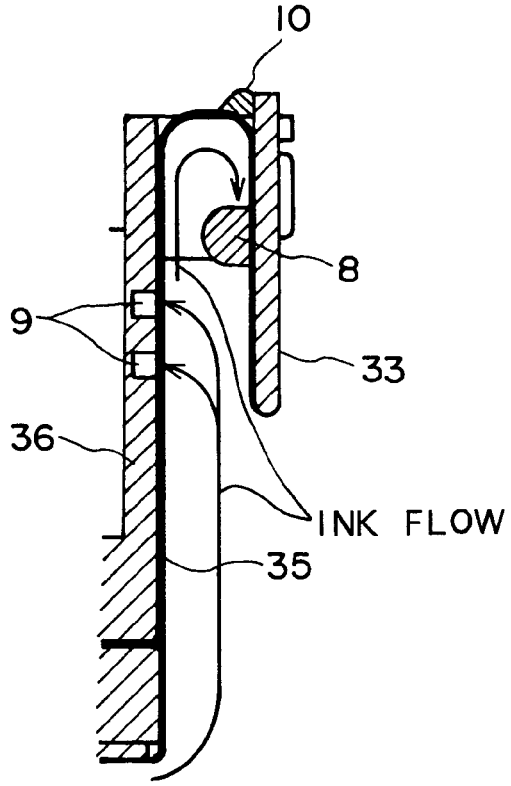
FIG. 13 is an enlarged schematic sectional view of the card edge contact of the recording head shown in FIG. 12, and its adjacencies.

Referring to FIG. 13, this sealant is coated also on the junction between the card edge contact 33 and flexible electrical cable 35, creating a sealing portion 10. With the provision of this sealing portion 10, the portion of the electrical wiring which is exposed when the card edge contact 33 is attached to the flexible electrical cable 35 with the application of heat and pressure is protected; should liquid come into contact with this portion, the electrical wiring neither short circuits, nor corrodes.

Further, the two grooves 9 with which the surface 36*d* of the ink container holder 36 is provided are 0.5 mm–1.0 mm in depth, and their length is greater than the width of the flexible electrical cable 35.

With the provision of this structural arrangement, even it such liquid as ink which has adhered to the recording head H1001C due to a recovery operation or the like begins to flow in the direction indicated by the arrows in FIG. 13, this flow of liquid, which moves on, for example, the flexible electrical cable 35 toward the card edge contact 33, is blocked by the ridge 8. Further, the liquid which flows on the surface 36*d* of the ink container holder 36 toward the card edge contact 33, following the edges of the flexible electrical cable 35, and the liquid which flows through the gap between the surface 36*d* of the ink container holder 36 and the flexible electrical cable 35 toward the card edge contact 33, is captured by the grooves 9.

As described above, in this embodiment, the liquid having adhered to the recording head H1001C is prevented by the ridge 8 and grooves 9 from reaching the card edge contact 33; it is prevented from adhering to the card edge contact 33. In other words, this embodiment can improve a recording head in terms of the electrical reliability of the card edge contact 33.

Incidentally, the shape and measurements of the above-described ridge 8 and grooves 9 do not need to be limited to those described above. In other words, they may be different from the above-described ones, as long as the liquid flow, which occurs as liquid adheres to the surface of the recording head H1001C, can be prevented from flowing to the card edge contact 33.

Figure 14:
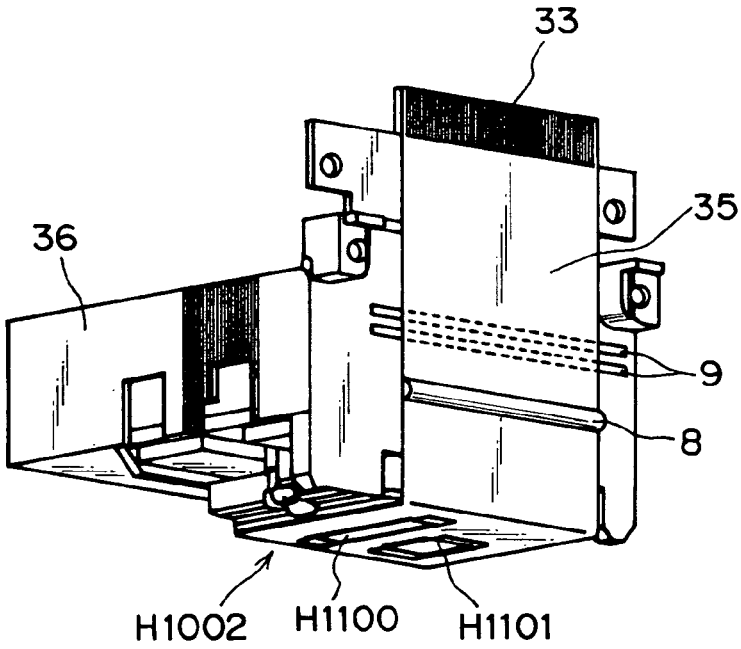
FIG. 14 is a schematic perspective view of one of the modified versions of the recording head shown in FIG. 12, which has been partially disassembled.

FIG. 14 is a schematic perspective view of one of the modifications of the recording head in this embodiment, which has been partially disassembled.

In the case of the recording head shown in FIG. 14, the ridge 8 on the flexible electrical cable 35 is positioned closer to the recording element unit H1002 than the grooves 9. Therefore, the ridge 8 can block the liquid flow on the flexible electrical cable 35 toward the card edge contact 33, at a point further away from the card edge contact 33 than the point shown in FIGS. 12 and 13, assuring that the liquid flow on the flexible cable 35 does not reach the card edge contact 33. The portions of the recording head in this embodiment other than those described above, which are the same in structure as the corresponding portions of the recording heads in the preceding embodiments, are the same in effect as those in the preceding embodiments.

Embodiment 4

Next, referring to FIGS. 15 and 16, the fourth embodiment of the present invention will be described.

Figure 15:
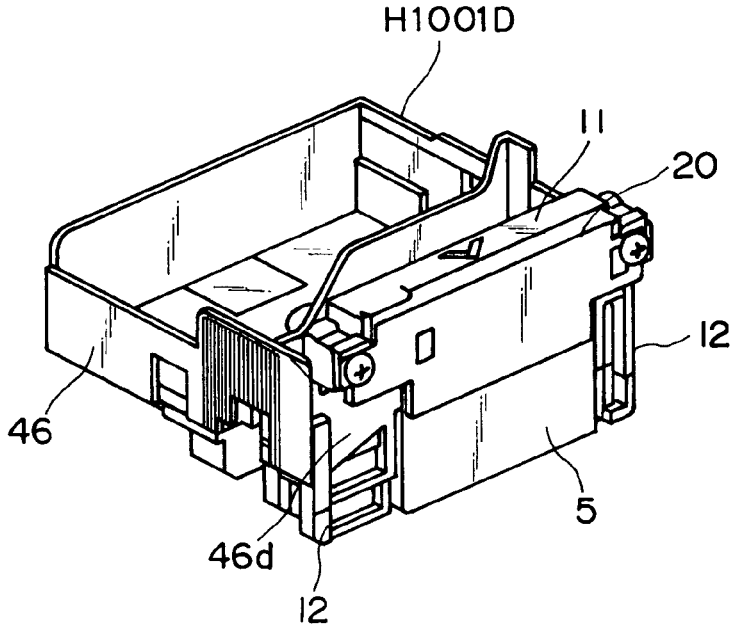
FIG. 15 is a schematic perspective view of the entirety of the recording head in the fourth embodiment of the present invention.
Figure 16:
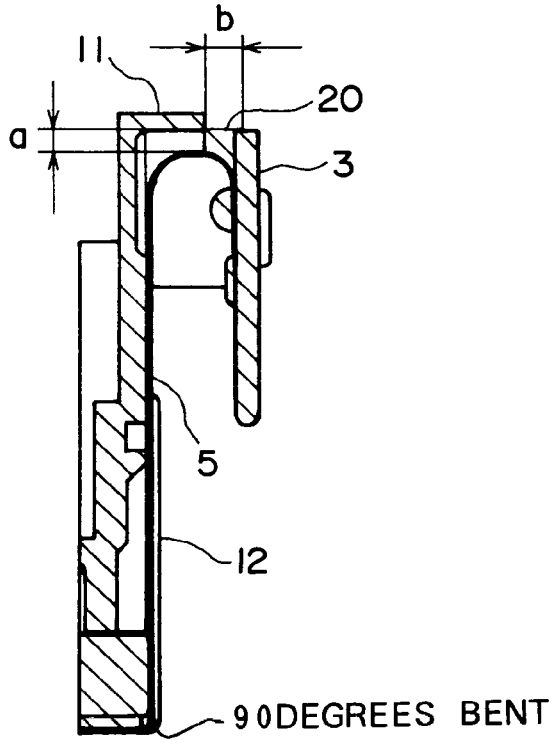
FIG. 16 is an enlarged schematic sectional view of the recording head shown in FIG. 15.

FIG. 15 is a schematic perspective view of the entirety of the recording head in the fourth embodiment of the present invention, and FIG. 16 is an enlarged schematic sectional view of the card edge contact of the recording head shown in FIG. 15, and its adjacencies. The components, members, portions, etc., in FIGS. 15 and 16, which are the same as those in the first to third embodiments, are given the same referential symbols as those given in the first to third embodiments, and will not be described in detail. The portions of this embodiment similar to those in the first to third embodiments are the same in effect as those in the first to third embodiments.

The flexible electrical cable 5 of the recording head H1001D in this embodiment is similar to the flexible electrical cable 5 shown in FIG. 7. That is, the flexible electrical cable 5 is sharply bent roughly 90° so that the flexible electrical cable 5 follows the surface 46*d* of the ink container holder 46, that is, the surface to which the flexible electrical cable 5 is bonded. Then, the flexible electrical cable 5 is arcuately bent by roughly 180° so that it is doubled back over the surface 46*d*. Then, the card edge contact 3 is solidly fixed to the ink container holder 46. Further, the ink container holder 46 is provided with an eave-like wall 11, which extends from the top end of the surface 46*d* over the arcuate portion of the flexible electrical cable 5 (outward side of the curvature), thereby covering the arcuate portion of the flexible electrical cable 5.

Referring to FIG. 16, the eave-like wall 11 is structured so that a gap a is provided between the arcuate portion of the flexible electrical cable 5 and the eave-like wall 11. With this structural arrangement, even if the absorption of the manufacturing tolerance or the like by the flexible electrical cable 5 changes the position of the arcuate portion of the flexible electrical cable 5, the eave-like wall 11 does not interfere with the flexible electrical cable 5. In this embodiment, the gap a was set in the range of 0.5 mm–1.0 mm to prevent interference between the eave-like wall 11 and the flexible electrical cable 5. However, the size of the gap a does not need to be limited to a value in this range. It may be changed as necessary according to the manufacturing tolerance in the measurement of the flexible electrical cable 5, etc.

Further, the eave-like wall 11 is shaped so that a gap b is provided between the eave-like wall 11 and the card edge contact 3. Thus, the exposed portion of the electrical connection between the card edge contact 3 and flexible electrical cable 5 is sealed by a sealing portion 20 formed by sealant injected into this gap b. Moreover, even if the card edge contact 3 is in the form of a card edge chip, the top end portion of the card edge chip where the electrical wiring is exposed is sealed by the sealing portion 20 as shown in FIG. 16.

Thus, the manufacturing method for the recording head H1001D in this embodiment comprises: a process for forming the eave-like wall 11 for covering the arcuate portion of the flexible electrical cable 5, which is next to the card edge contact 3; and a process for sealing the gap between the eave-like wall 11 and the card edge contact 3.

Further, referring to FIGS. 15 and 16, the ink container holder 46 is provided with a pair of ridges 12, which are located at both vertical edges of the surface 46*d* of the ink container holder 46, to which the portion of the flexible electrical cable 5 is solidly bonded with glue after being bent by approximately 90° to make the flexible electrical cable 5 follow the end surface of the recording element unit (unshown). With reference to the surface 46*d* of the ink container holder 46, to which the flexible electrical cable 5 is bonded, these ridges 12 of the ink container holder surface 46*d* project outward further than the outer surface of the portion of the flexible electrical cable 5 by which the flexible electrical cable 5 is bonded to the surface 46*d*.

In the case of the recording head H1001D in this embodiment, the arcuate portion of the flexible electrical cable 5, which freely deforms as external force acts on it, is covered with the eave-like wall 11 positioned above the arcuate portion (position corresponding to the arcuate portion), thereby being protected. Therefore, the arcuate portion of the flexible electrical cable 5 is prevented from being subjected to external force. Therefore, the problem of the flexible electrical cable 5 breaking off due to deformation of the flexible electrical cable 5 caused by external force, and the like problems, can be prevented, making the recording head more reliable in terms of the electrical connection.

Further, since the gap b is provided between the eave-like wall 11 and card edge contact 3, the force of the meniscus which the sealant forms between the eave-like wall 11 and card edge contact 3 adds to the force which retains the sealant. Therefore, a sealant with a relatively low degree of viscosity can be used to assure that the electrical junction remains sealed.

Further, the ink container holder 46 is provided with the ridges 12 which project outwardly further than the outer surface of the portion of the flexible electrical cable 5 bonded to the surface 46*d* of the ink container holder 46. Therefore, when the recording head H1001D is mounted into a recording apparatus (unshown), or removed therefrom, the ridges 12 of the recording head H1001D come into contact with the components on the recording apparatus side, thereby preventing the point of the flexible electrical cable 5 at which the flexible electrical cable 5 is bent by 90°, and the surface of the portion of the flexible electrical cable 5 bonded to the surface 46*d* of the recording head H1001D, from coming into contact with the components on the recording apparatus side. In other words, the recording head H1001D is provided with the ridges 12 so that the point of the flexible electrical cable 5 at which the flexible electrical cable 5 is bent by 90°, and the surface of the portion of the flexible electrical cable 5 bonded to the surface 46*d* of the recording head H1001D, do not interfere with the components on the recording apparatus side.

With the provision of this structural arrangement, the flexible electrical cable 5 of the recording head H1001D in this embodiment does not suffer from the problem that, when a recording head is mounted into, or dismounted from, the recording apparatus, the flexible electrical cable 5 breaks due to its contact with the components of the recording apparatus side. Further, the prevention of contact between the flexible electrical cable 5 and the components on the recording apparatus side can prevent the problem that, during an operation such as a recovery operation, in which the surface of the recording head having the liquid ejection holes is wiped with a blade, liquid that has adhered to the flexible electrical cable 5 is transferred onto the components on the recording apparatus side. Therefore, the problem that the liquid that has been transferred onto the components on the recording apparatus side adheres to (soils) the recording medium or the like can be prevented. The structural components in this embodiment other than the above-described ones are the same in effect as the corresponding structural components in the preceding embodiments.

Miscellaneous Embodiments

Figure 17:
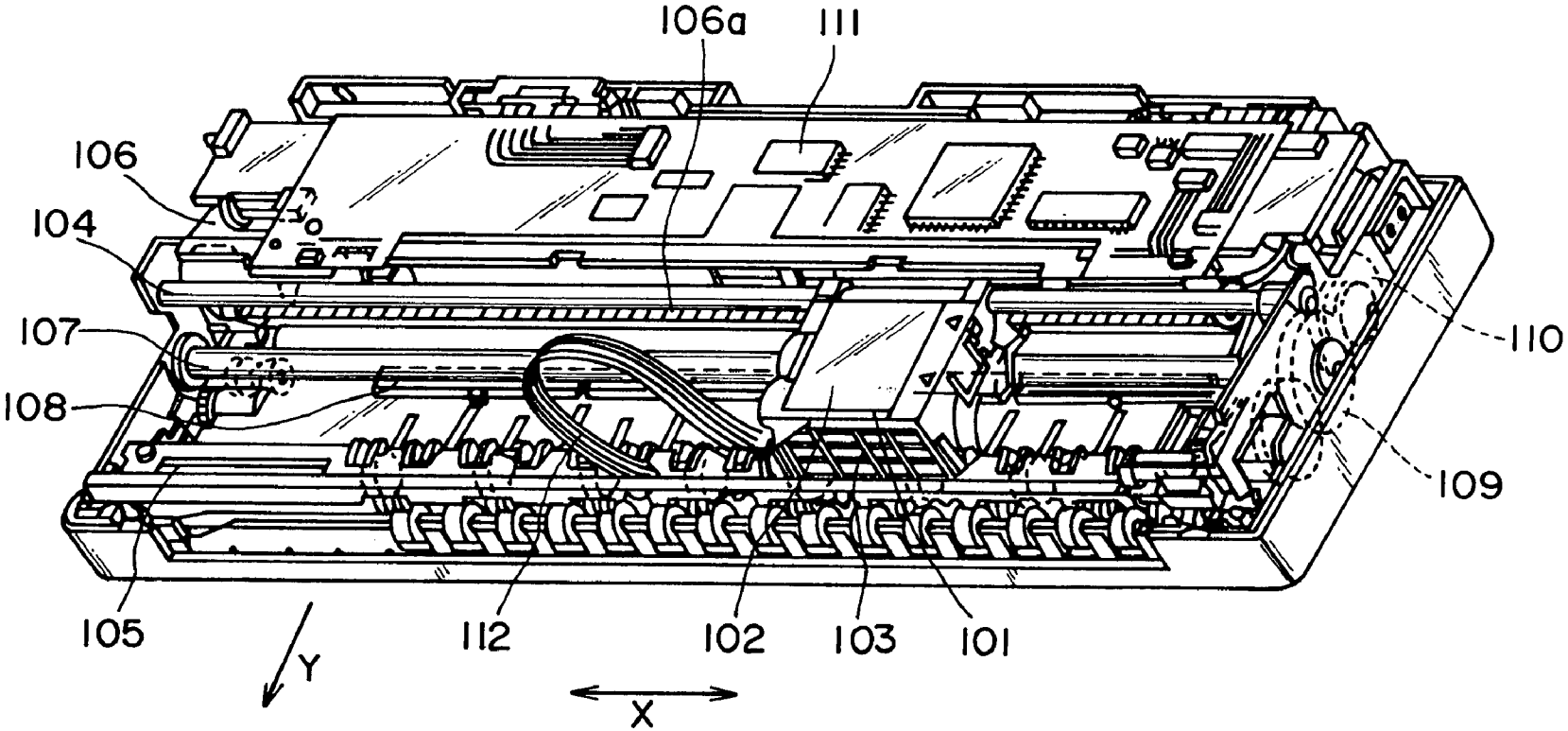
FIG. 17 is an enlarged perspective view of the entirety of one of the recording apparatuses in accordance with the present invention.

FIG. 17 is a perspective view of the entirety of one of the recording apparatuses in accordance with the present invention.

The recording apparatus shown in FIG. 17 is an ordinary serial type recording apparatus for forming characters, symbols, images, etc., on a recording sheet, by adhering ink to a recording sheet by selectively causing ink to be ejected from the liquid ejection holes of the recording head 101 in synchronism with the repetition of the reciprocal movement (primary scan) of the recording head 101 in the primary scanning direction, and the conveyance (secondary scan), at a predetermined pitch, of a recording sheet (recording medium) such as ordinary recording paper, special recording paper, OHP film, etc., in the secondary scanning direction.

As shown in FIG. 17, the recording head 101 is removably held by a carriage 103 as a head holding member, along with an ink container 102 which holds the ink used for image formation. The carriage 103 is held and guided by a guide shaft 104 and a guide rail 105 solidly fixed in the recording apparatus, therefore being allowed to move only in the directions (primary scanning direction) indicated by the arrow heads X in FIG. 17. The carriage 103 is reciprocally driven by a CR motor 106 as a driving means, by a carriage belt 106*a*. In other words, the guide shaft 104, guide rail 105, CR motor 106, and carriage belt 106*a* make up a scanning means for reciprocally moving the carriage 103.

An unshown recording medium on which recording is made by the recording head 101 is held by being pinched between an LF roller 107 and a pinch roller 108 rotationally disposed in the recording apparatus. As the LF roller 107 is rotationally driven by an LF motor 110 through an LF gear 109, the recording medium is conveyed in the direction (secondary scanning direction) indicated by the arrow Y, which is perpendicular to the direction indicated by the arrow heads X, as shown in FIG. 17.

There is a control chip 111 in the recording apparatus. A control circuit as a controlling means on the control chip 111 generates control signals for the recording head 101, CR motor 106, and LF motor 110, thereby controlling their operations. The recording head 101 and control chip 111 are electrically connected to each other through a flexible cable 112 as a signal transmitting means. Therefore, the recording head 101 and control chip 111 are allowed to transmit control signals to each other through the flexible cable 112 even while the recording head 101 is making the scanning movement in the directions of the arrow heads X.

The recording head 101 has plural lines of nozzles, each line corresponding to a specific color. Thus, recoding is made by selectively causing the nozzles to eject ink. The recording head 101 has a plurality of energy generating means for generating energy to be given to the ink in the nozzles to eject ink droplets from the nozzles. In this embodiment, the energy generating means is a heat generating resistor serving as an electro-thermal transducer element, provided per nozzle. The signals for driving the recording head 101 are transmitted from the control chip 111 to the recording head 101 through the electrical junction between the control chip 111 and flexible cable 112, the flexible cable 112, and the electrical junction between the flexible cable 112 and the recording head 101, and ink is ejected from the recording head 101 in response to the transmitted driving signals.

Figure 18A:
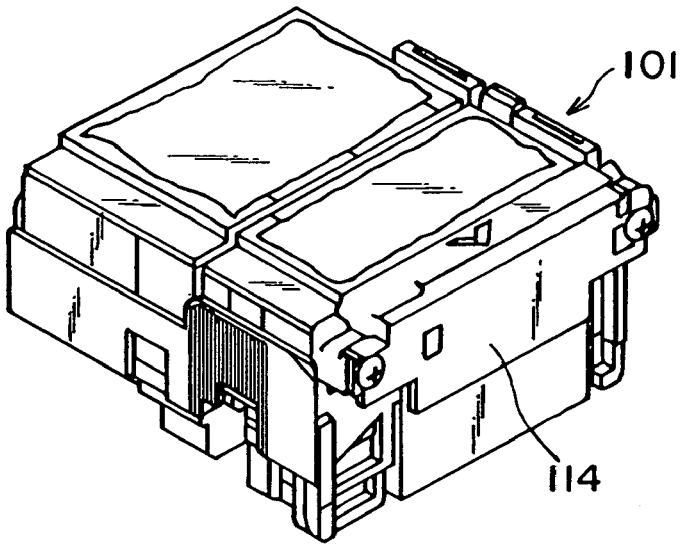
FIG. 18A is a perspective view of the recording head shown in FIG. 17, as seen from the back side thereof.
Figure 18B:
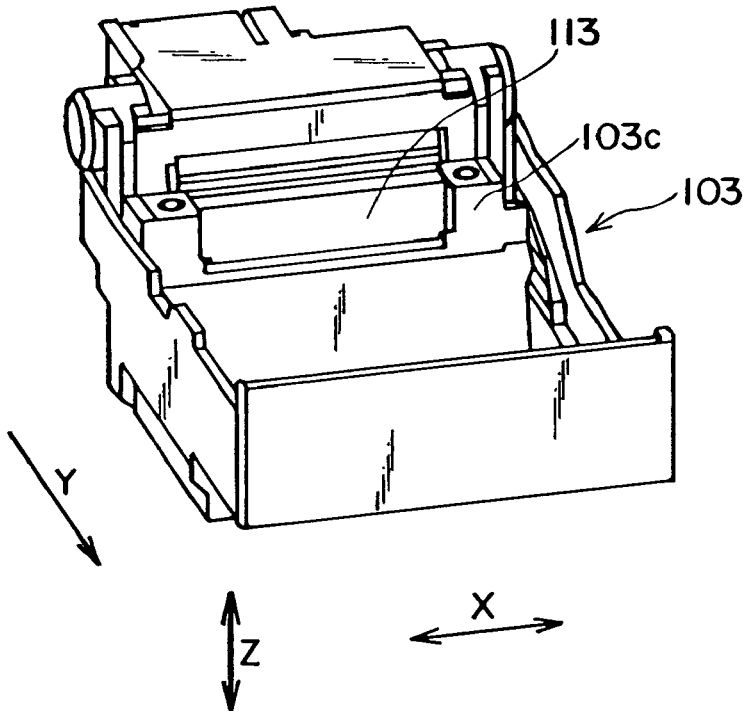
FIG. 18B is a perspective view of the carriage shown in FIG. 17, as seen from the front side thereof.

FIG. 18A is a perspective view of the recording head shown in FIG. 17, as seen from the back side, and FIG. 18B is a perspective view of the carriage shown in FIG. 17, as seen from the front side.

One end of the recording head 101 is provided with a card edge chip 114, and the driving signals are transmitted to the lines of nozzles through an unshown wiring. The card edge chip 114 is a plug portion, that is, an end portion of the wiring chip of the recording head 101, and it has a pattern formed of an electrically conductive substance. As described above, it is solidly fixed to the ink container holder.

The top side of the carriage 103 has an open space into which the recording head 101 is inserted from above. As the recording head 101 is pushed into the open space in the downward direction indicated by one of the arrow heads Z, which is perpendicular to both the X and Y directions, the recording head 101 is properly set in the carriage 103.

The carriage 103 has a card edge connector 113 with which the card edge chip 114 engages. The card edge connector 113 is inside the carriage 103, and is movable relative to the connector supporting portion 103*c* of the carriage 103 in both the C and Y directions. The card edge connector 113 is rectangular, being longer in the X direction and shorter in the Y direction. The card edge connector 113 has a hole into which the card edge chip 114 of the recording head 101 is inserted, and which is open upward. The back side of the card edge connector 113, that is, the side which cannot be seen in FIGS. 18A and 18B, is connected to one end of the flexible cable 112 (FIG. 17), with the use of solder. In other words, the card edge connector 113 and flexible cable 112 make up the signal transmitting means for transmitting driving signals from the control chip 111 to the recording head 101 on the carriage 103.

As is evident from the above description, the recording apparatus in this embodiment has: the carriage 103 as a head holding member capable of removably holding any of the recoding heads in the preceding embodiments of the present invention described above; the electrical contact terminal to be connected to the electrical contact points of the card edge contact of a liquid ejection recording head; and the card edge connector 113 attached to the carriage 103.

As described above, in the case of the recording apparatuses in the preceding embodiments, the card edge contact and recording element chip of the liquid ejection recording head are electrically connected to each other through the flexible electrical cable. Therefore, the card edge contact can be attached to any area of the liquid ejection recording head, in any orientation.

Therefore, it is possible to improve a liquid ejection recording head in terms of the electrical connection, by placing a card edge connector in a position and an orientation in which liquid such as ink is unlikely to adhere to the area of electrical connection of the recording head. Further, not only is it possible to make it easier to mount a liquid ejection recording head into a recording apparatus by matching the location of the liquid ejection recording head to which a card edge contact is attached, and the orientation in which the card edge contact is attached, with the direction and orientation in which the liquid ejection recording head is inserted into a recording apparatus, and the direction and orientation in which the card edge contact of the recording head is inserted into the connector of the recording apparatus, but it is also possible to reduce the internal space of the recording apparatus necessary to mount the liquid ejection recording head into the recording apparatus, thereby making it possible to reduce the recording apparatus size.

While the invention has been described with reference to the structures disclosed herein, it is not confined to the details set forth, and this application is intended to cover such modifications or changes as may come within the purposes of improvements or the scope of the following claims.

What is claimed is:

1. A liquid ejecting head comprising:

a card edge contact having a plurality of electrical contacts for transmission of a driving signal;

a recording element substrate having a recording element for generating energy contributable to eject liquid onto a recording material in response to the driving signal; and an electrical flexible cable for electrical connection between said card edge contact and said recording element substrate, and a projection for damming flow of the liquid deposited on a surface so as to prevent the liquid from flowing toward said card edge contact.

2. A liquid ejecting head according to claim 1, wherein an inserting direction of said card edge contact into a card edge connector with which said card edge contact is electrically connected is substantially perpendicular or parallel to a direction in which the liquid is ejected from said recording element substrate.

3. A liquid ejecting head according to claim 1, wherein said electrical flexible cable extends substantially in a U-like shape between a surface of a casing of said liquid ejection recording head and a member that has said card edge contact and that is disposed opposed to said surface of said casing.

4. A liquid ejecting head according to claim 3, wherein the U-like shape has an opening in a direction substantially the same as a direction in which the liquid is ejected.

5. A liquid ejecting head according to claim 1, wherein said card edge contact comprises a card edge substrate comprising a rigid base plate on which wiring leads constituting a circuit are formed.

6. A liquid ejecting head according to claim 1, wherein said projection is provided on said electrical flexible cable, and extends in a direction crossing a direction of flow of the liquid toward said card edge contact.

7. A recording device comprising:

a head holding member for detachably holding a liquid ejection recording head as defined in claim 1;

a plurality of electrical contacts to be connected with respective electrical contacts provided in the card edge contact of the liquid ejection recording head; and a card edge connector mounted to the head holding member.

8. A liquid ejecting head comprising:

a card edge contact having a plurality of electrical contacts for transmission of a driving signal;

a recording element substrate having a recording element for generating energy contributable to eject liquid onto a recording material in response to the driving signal; and an electrical flexible cable for electrical connection between said card edge contact and said recording element substrate, and a main body portion supporting said card edge contact and said recording element substrate, wherein said main body portion is provided with a connection surface for connection with said electrical flexible cable, and said connection surface has a groove for stopping flow of the liquid, deposited on a surface of said liquid ejection recording head, toward said card edge contact.

9. A liquid ejecting head according to claim 8, wherein said groove is extended in a direction crossing a direction in which the liquid flows toward said card edge contact.

10. A liquid ejecting head according to claim 8, wherein said main body portion has an ink container holder for holding an ink container for containing the liquid.

11. A liquid ejecting head according to claim 8, wherein an inserting direction of said card edge contact into a card edge connector with which said card edge contact is electrically connected is substantially perpendicular or parallel to a direction in which the liquid is ejected from said recording element substrate.

12. A liquid ejecting head according to claim 8, wherein said electrical flexible cable extends substantially in a U-like shape between a surface of a casing of said liquid ejection recording head and a member that has said card edge contact and that is disposed opposed to said surface of said casing.

13. A liquid ejecting head according to claim 12, wherein the U-like shape has an opening in a direction substantially the same as a direction in which the liquid is ejected.

14. A liquid ejecting head according to claim 8, wherein said card edge contact comprises a card edge substrate comprising a rigid base plate on which wiring leads constituting a circuit are formed.

15. A recording device comprising:

a head holding member for detachably holding a liquid ejection recording head as defined in claim 8;

a plurality of electrical contacts to be connected with respective electrical contacts provided in the card edge contact of the liquid ejection recording head; and a card edge connector mounted to the head holding member.

16. A manufacturing method for manufacturing a liquid ejection recording head including a card edge contact having a plurality of electrical contacts for transmission of a driving signal; a recording element substrate having a recording element for generating energy contributable to eject liquid onto a recording material in response to the driving signal; a recording element unit supporting the recording element substrate; and a main body supporting the card edge contact and the recording element substrate, wherein the card edge contact and the recording element substrate are electrically connected by an electrical flexible cable, said method comprising the steps of:

connecting the electrical flexible cable to the recording element unit while the recording element substrate and the card edge contact are in electrical connection with each other, and mounting the recording element unit on one side of the main body;

bending the electrical flexible cable so as to be along another side of the main body which is adjacent to the one side;

connecting at least a part of the electrical flexible cable to the other side of the main body; and mounting the card edge contact to the main body, with a portion of the electrical flexible cable being not connected with the main body and being bent at a predetermined angle, wherein the card edge contact and the main body are provided with respective holes through which fixing means for fixing the card edge contact to the main body are provided, and the hole in the card edge contact is elongated in a direction perpendicular to a direction in which the electrical flexible cable extends from the recording element substrate to the card edge contact.

17. A method according to claim 16, wherein the predetermined angle is such that a direction of insertion of the card edge contact into a card edge connector to which the card edge contact is electrically connected is substantially perpendicular or parallel to a direction of ejection of the liquid.

18. A method according to claim 16, wherein the main body has an ink container holder for holding an ink container for containing the liquid.

19. A manufacturing method for manufacturing a liquid ejection recording head including a card edge contact having a plurality of electrical contacts for transmission of a driving signal; a recording element substrate having a recording element for generating energy contributable to eject liquid onto a recording material in response to the driving signal; a recording element unit supporting the recording element substrate; and a main body supporting the card edge contact and the recording element substrate, wherein the card edge contact and the recording element substrate are electrically connected by an electrical flexible cable, said method comprising the steps of:

connecting the electrical flexible cable to the recording element unit while the recording element substrate and the card edge contact are in electrical connection with each other, and mounting the recording element unit on one side of the main body;

bending the electrical flexible cable so as to be along another side of the main body which is adjacent to the one side;

connecting at least a part of the electrical flexible cable to the other side of the main body;

mounting the card edge contact to the main body, with a portion of the electrical flexible cable being not connected with the main body and being bent at a predetermined angle; and providing a projection for damming flow of the liquid deposited on a surface so as to prevent the liquid from flowing toward the card edge contact.

20. A method according to claim 19, wherein the predetermined angle is such that a direction of insertion of the card edge contact into a card edge connector to which the card edge contact is electrically connected is substantially perpendicular or parallel to a direction of ejection of the liquid.

21. A method according to claim 19, wherein the main body has an ink container holder for holding an ink container for containing the liquid.

22. A manufacturing method for manufacturing a liquid ejection recording head including a card edge contact having a plurality of electrical contacts for transmission of a driving signal; a recording element substrate having a recording element for generating energy contributable to eject liquid onto a recording material in response to the driving signal; a recording element unit supporting the recording element substrate; and a main body supporting the card edge contact and the recording element substrate, wherein the card edge contact and the recording element substrate are electrically connected by an electrical flexible cable, said method comprising the steps of:

connecting the electrical flexible cable to the recording element unit while the recording element substrate and the card edge contact are in electrical connection with each other, and mounting the recording element unit on one side of the main body;

bending the electrical flexible cable so as to be along another side of the main body which is adjacent to the one side;

connecting at least a part of the electrical flexible cable to the other side of the main body;

mounting the card edge contact to the main body, with a portion of the electrical flexible cable being not connected with the main body and being bent at a predetermined angle; and providing a groove on the other side of the main body, to which at least a part of the electrical flexible cable is connected, wherein the groove is for stopping flow of the liquid, deposited on a surface of the liquid ejection recording head, toward the card edge contact.

23. A method according to claim 22, wherein the predetermined angle is such that a direction of insertion of the card edge contact into a card edge connector to which the card edge contact is electrically connected is substantially perpendicular or parallel to a direction of ejection of the liquid.

24. A method according to claim 22, wherein the main body has an ink container holder for holding an ink container for containing the liquid.

* * * * *

UNITED STATES PATENT AND TRADEMARK OFFICE

CERTIFICATE OF CORRECTION

PATENT NO. : 7,036,910 B2
APPLICATION NO. : 10/670398
DATED : May 2, 2006
INVENTOR(S) : Tetsuya Ohashi et al.

It is certified that error appears in the above-identified patent and that said Letters Patent is hereby corrected as shown below:

ON THE TITLE PAGE
Item (30), Foreign Application Priority Data, "2002/287546" should read --2003-287546--, and "2003/021889" should read --2003-021889--.

COLUMN 6
Line 48, "substrate H110" should read --substrate H1110--.
Line 51, "substrate H110" should read --substrate H1110--.

COLUMN 13
Line 29, "it" should read --if--.

COLUMN 18
Line 16, "and" should be deleted.
Line 19, "substrate," should read --substrate;--.
Line 59, "and" should be deleted.
Line 62, "substrate," should read --substrate;--.

Signed and Sealed this

Fourth Day of March, 2008

JON W. DUDAS
*Director of the United States Patent and Trademark Office*